US008177327B2

(12) United States Patent
Izawa et al.

(10) Patent No.: US 8,177,327 B2
(45) Date of Patent: May 15, 2012

(54) INK JET RECORDING APPARATUS

(75) Inventors: Hideo Izawa, Narashino (JP); Takao Namiki, Narashino (JP); Akira Ishikawa, Narashino (JP); Yuuichi Yamazaki, Narashino (JP)

(73) Assignee: Miyakoshi Printing Machinery Co., Ltd., Narashino-shi (JP)

( * ) Notice: Subject to any disclaimer, the term of this patent is extended or adjusted under 35 U.S.C. 154(b) by 273 days.

(21) Appl. No.: 12/648,051

(22) Filed: Dec. 28, 2009

(65) Prior Publication Data

US 2010/0194821 A1 Aug. 5, 2010

(30) Foreign Application Priority Data

Jan. 30, 2009 (JP) ..... 2009-019868

(51) Int. Cl.
*B41J 23/00* (2006.01)

(52) U.S. Cl. ..... 347/37

(58) Field of Classification Search ..... 347/37
See application file for complete search history.

(56) References Cited

U.S. PATENT DOCUMENTS 6,341,845 B1 1/2002 Scheffelin et al.
2005/0280678 A1 12/2005 Bibl et al.

FOREIGN PATENT DOCUMENTS

JP 2006-188013 A 7/2006
WO 2006/082445 A2 8/2006

OTHER PUBLICATIONS

European Search Report dated Mar. 19, 2010, issued in corresponding European Patent Application No. 10150101.3.

*Primary Examiner* — Lamson Nguyen
(74) *Attorney, Agent, or Firm* — Westerman, Hattori, Daniels & Adrian, LLP

(57) ABSTRACT

An ink jet recording apparatus in which a head supporting plate having a line head mounted thereon which comprises a plurality of short heads staggered is attached to a carriage whereby recording is performed by ink jet printing with the line head on a recording medium positioned beneath the carriage is rendered capable of using ordinary short heads.

To this end, in an ink jet recording apparatus in which a head supporting plate 12 having a line head mounted thereon which comprises a plurality of short heads 11 staggered is attached to a carriage 9 whereby recording is performed by ink jet printing with the line head on a recording medium 2 positioned beneath the carriage, a portion of projection 25 is provided which is formed on a surface of attachment where the head supporting plate is attached to the carriage, the portion of projection entering into a hole 26 formed in the carriage; and a portion of recess is provided which is formed on an obverse side of the head supporting plate and at a position corresponding to that of the portion of projection and whose inner bottom surface becomes a head mounting surface 27 on which a said short head having a nozzle is to be mounted, the head mounting surface being formed with a nozzle accepting hole adapted to accept the nozzle of the short head for mounting the short head on the head mounting surface.

3 Claims, 8 Drawing Sheets

INK JET RECORDING APPARATUS

TECHNICAL FIELD

The present invention relates to an ink jet recording apparatus in which a recording medium, mainly a fabric, is printed (textile-printed) by ink jet in a serial printing method and, in particular, to an ink jet recording apparatus comprising a plurality of line heads each of which comprises short (length) heads having short (length) nozzle rows and staggered in a plurality of rows.

BACKGROUND ART

In an ink jet recording operation by a serial printing method, the speed of scanning is limited by several conditions and has an upper limit that exists, which requires increasing the area of recording for each single operation in order to improve the production efficiency. And, to increase the area of recording, there has hitherto been known an apparatus in which short heads are staggered to constitute a line head for ink jet recording (see JP 2006-188013 A).

In the prior art, however, the structure that a short head is mounted on a surface of a head supporting plate of a given thickness has required the distance between the surface of a nozzle of the short head and the surface of a recording medium to be greater by the thickness of the head supporting plate and thus the nozzle surface of the short head to be projected greater by that amount from the main body of the short head. As a result, there has been the inconvenience that as the short head, one which has a special shape must be used.

DISCLOSURE OF THE INVENTION

In order to solve the problem mentioned above, the present invention provides, in a first aspect thereof, an ink jet recording apparatus in which a head supporting plate having a line head mounted thereon which comprises a plurality of short heads staggered is attached to a carriage whereby recording is performed by ink jet printing with the line head on a recording medium positioned beneath the carriage, the apparatus comprising:

- a portion of projection formed on a surface of attachment where the head supporting plate is attached to the carriage, the portion of projection entering into a hole formed in the carriage; and
- a portion of recess which is formed on an obverse side of the head supporting plate and at a position corresponding to that of the portion of projection and whose inner bottom surface becomes a head mounting surface on which a said short head having a nozzle is to be mounted,
- the head mounting surface being formed with a nozzle accepting hole adapted to accept the nozzle of the short head for mounting the short head on the head mounting surface.

And, the present invention provides, in a second aspect thereof, an ink jet recording apparatus as mentioned above in which:

- the short head is provided at its two longitudinal ends with two mounting flanges one of which is formed on its end face with a V-shaped groove and the other of which is formed with a positioning surface that is parallel to its longitudinal direction;
- the head mounting surface of the head supporting plate is provided with a first positioning pin adapted to engage with the V-shaped groove of the one flange of the short head and a second positioning pin adapted for contact with the positioning surface of the other flange of the short head.

The present invention further provides, in a third aspect thereof, an ink jet recording apparatus as mentioned above in which it comprises:

A swing unit, whereby

- the head supporting plate with its one longitudinal end portion adapted to fit with a positioning pin provided on the carriage is adapted to swing on a surface of the said carriage; and
- the head supporting plate has a swing unit connected to its other longitudinal end portion for swinging the head supporting plate on the surface of the carriage.

According to the first aspect of the present invention, it should be noted that even with an ink jet recording apparatus in which a line head comprising a plurality of short heads is mounted on a head supporting plate having of a given thickness, for each of the short heads a short head of ordinary or standard specification can be used to allow the nozzle surface to take a proper position for the recording medium positioned beneath the head supporting plate of the short head and to allow the recording medium if of fabric to be textile-printed with an improved quality.

Also, according to the second aspect of the present invention, it should be noted that each of the short heads constituting a line head can be mounted accurately on the mounting surface of the head supporting plate with the simple positioning means.

Further, according to the third aspect of the present invention, it should be noted that the head supporting plate having a line head mounted thereon can simply be registered with the carriage.

BEST MODES FOR CARRYING OUT THE INVENTION

Figure 1:
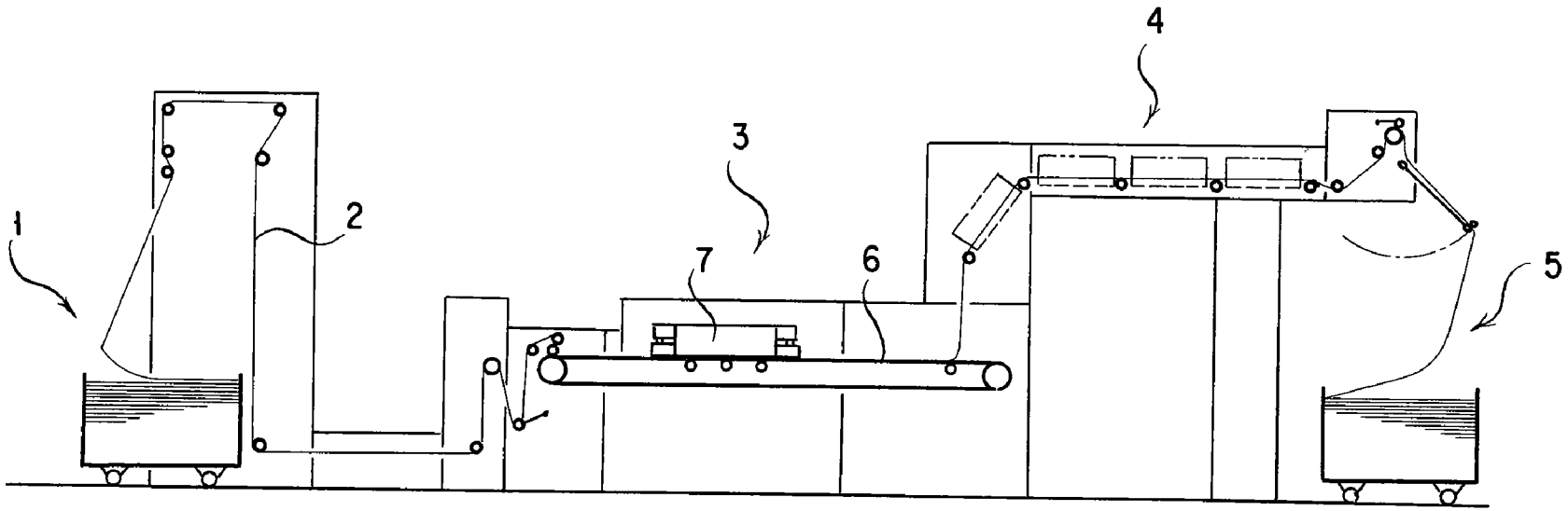
FIG. 1 is a front view illustrating an ink jet recording apparatus according to the present invention.

FIG. 1 is a front view that diagrammatically illustrates an ink jet recording apparatus according to the present invention. As shown, the apparatus includes a fabric supply section 1 that supplies a fabric 2 as a recording medium, an ink jet recorder section 3 for printing on a surface of the fabric 2 with ink jet as the fabric 2 is driven to travel. It also is shown to include a dryer section 4 and a folder section 5. And, the ink jet recorder section 3 comprises a fabric conveyer 6 for conveying the fabric 2, and a recording head unit 7 disposed as opposed to the fabric conveyer 6 from its upper side.

Figure 2:
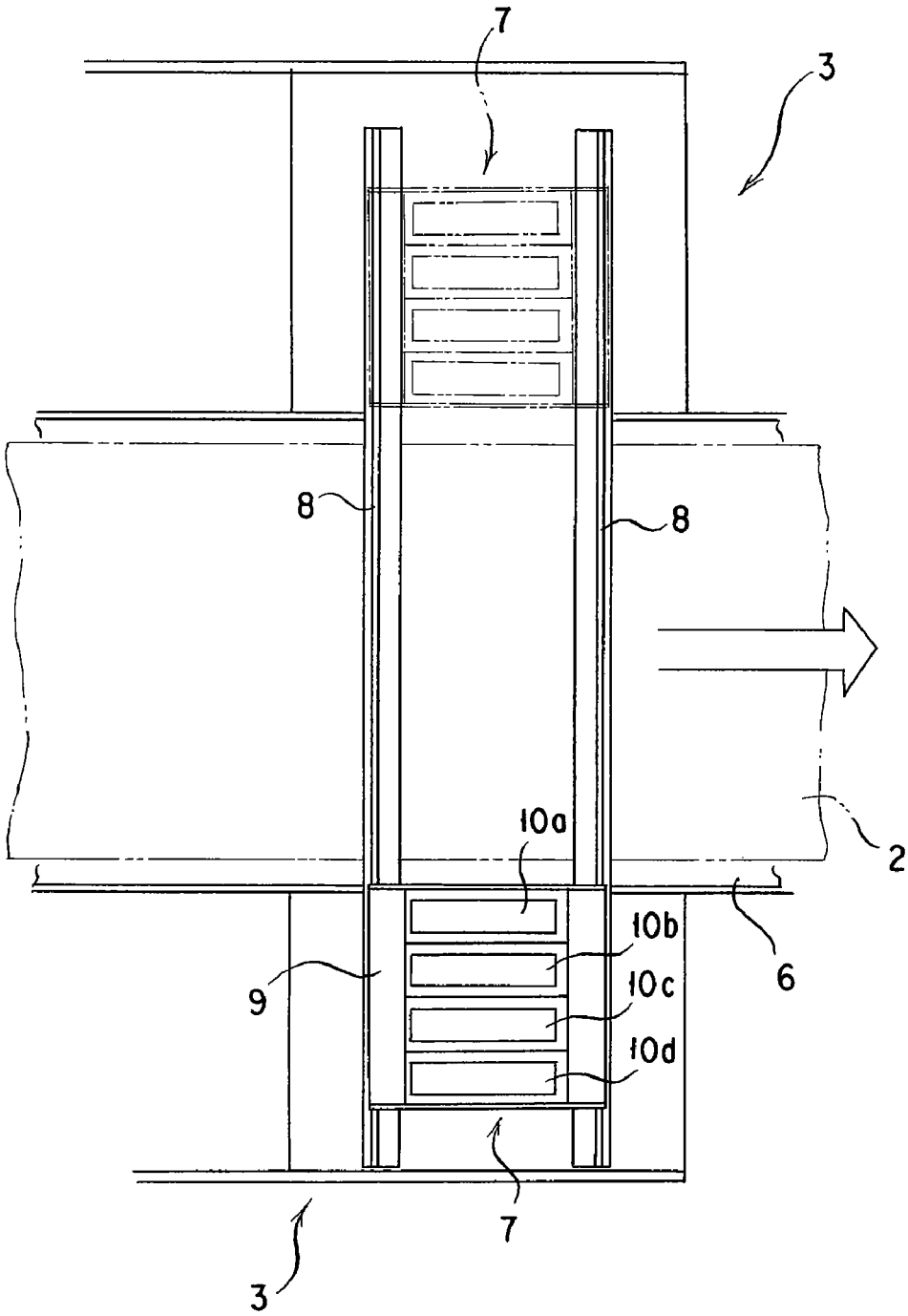
FIG. 2 is a plan view illustrating an ink jet recorder section in the apparatus shown in FIG. 1.

The recording head unit 7 as shown in FIG. 2 comprises a carriage 9 movable on and along rails 8 and 8 in a direction orthogonal to a direction in which the fabric 2 is conveyed to travel; and a plurality of, e.g., four (Y, M, C and K), rows of line heads 10*a*, 10*b*, 10*c* and 10*d* disposed on the carriage 9 and having their individual nozzle rows lying parallel to the direction of travel of the fabric 2, are arranged parallel in the direction of movement of the carriage 9. And, the recording head unit 7 is designed to perform one cycle of printing each time the carriage is moved in one direction or reciprocated in the state that the fabric 2 comes to a halt. Thereafter, the fabric 2 is conveyed to travel for a period, by a length of the line heads 10*a*-10*d* or a length that is the sum of the length of the line heads 10*a*-10*d* plus a given length, and is then brought to a halt. Printing is thus performed, namely by repeating such a printing operation and intermittent conveyance of the fabric 2, whereby on a surface of the fabric 2 images continuous over a selected length in its traveling direction or images mutually spaced apart with a given spacing in the direction of its travel is/are repetitively printed.

Figure 3:
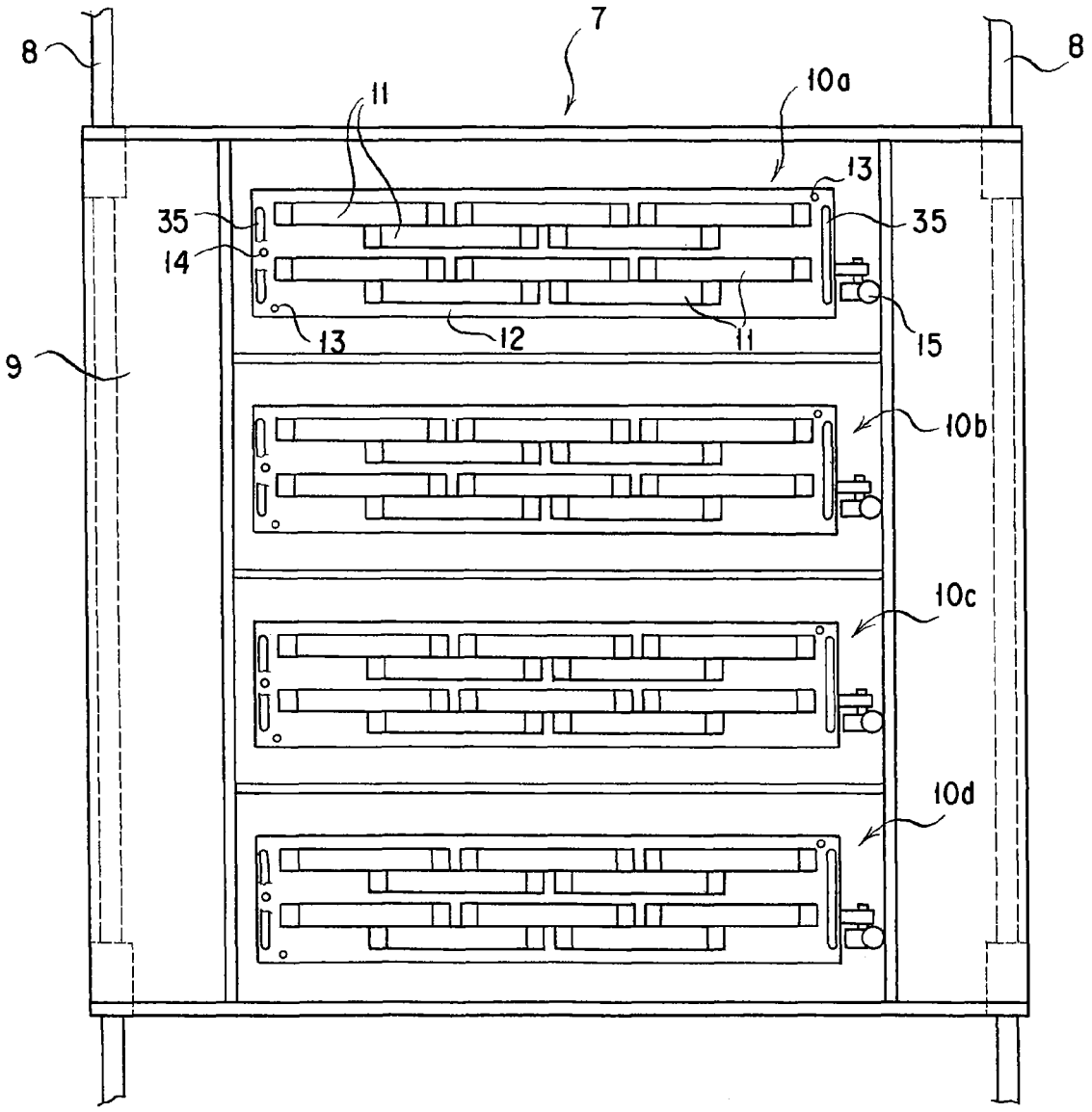
FIG. 3 is a plan view diagrammatically illustrating a recording head unit in the apparatus.
Figure 4:
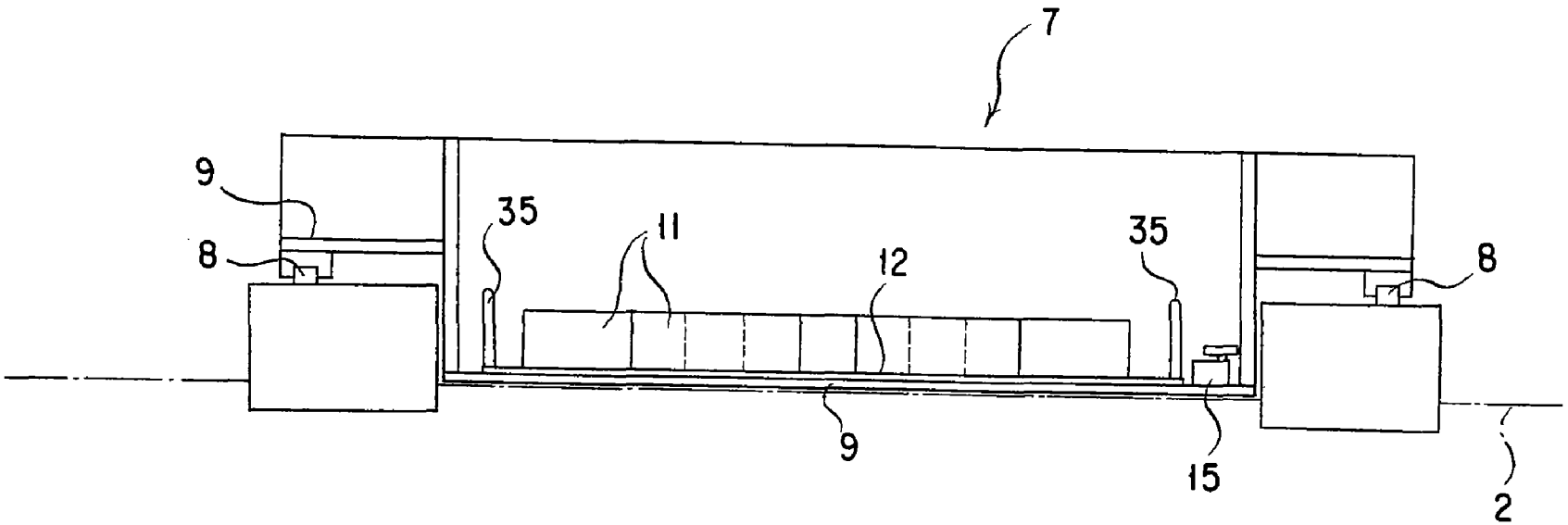
FIG. 4 is a front view diagrammatically illustrating the recording head unit in the apparatus.

Here, each of the line heads 10*a*-10*b* which if made up of a single head alone is hard to obtain a desired length is made up, as shown in FIG. 3, so as to comprise longitudinally, e.g. five ordinary or standard short heads 11 staggered (alternately overlapped). While each line head in this form of implementation is shown comprising two rows of short heads, it may comprise a single row of short heads. Further, the number of such short heads 11 in each row is not limited to five but may be three; three short heads 11 may be staggered. The short heads 11 in each of the line heads 10*a*-10*d* are shown mounted to the carriage 9 via each of head supporting plates 12.

Each head supporting plate 12 is designed to be fastened to the carriage 9 by fastening screws 13 and 13 at its both ends. The head supporting plate 12 is also designed at its one end to engage with a positioning pin 14 protruding on the carriage 9 so that it can swing about the pin as a fulcrum in a plane on the carriage 9. It has its other end connected to a swing unit 15 mounted on the carriage 9. The head supporting plate 12 is thus designed so that it can be regulated in its position by driving the swing unit 15 to swing it in a swing direction (skew direction) on an upper surface of the carriage 9 about the positioning pin 14 as the fulcrum before it is fastened by the fastening screws 13 and 13. Being passed by the fastening screw 13, a bolt hole which is formed in the head supporting plate 12 is larger in diameter than the fastening screw 13 so as to make it possible to absorb a movement of the head supporting plate 12.

Figure 5:
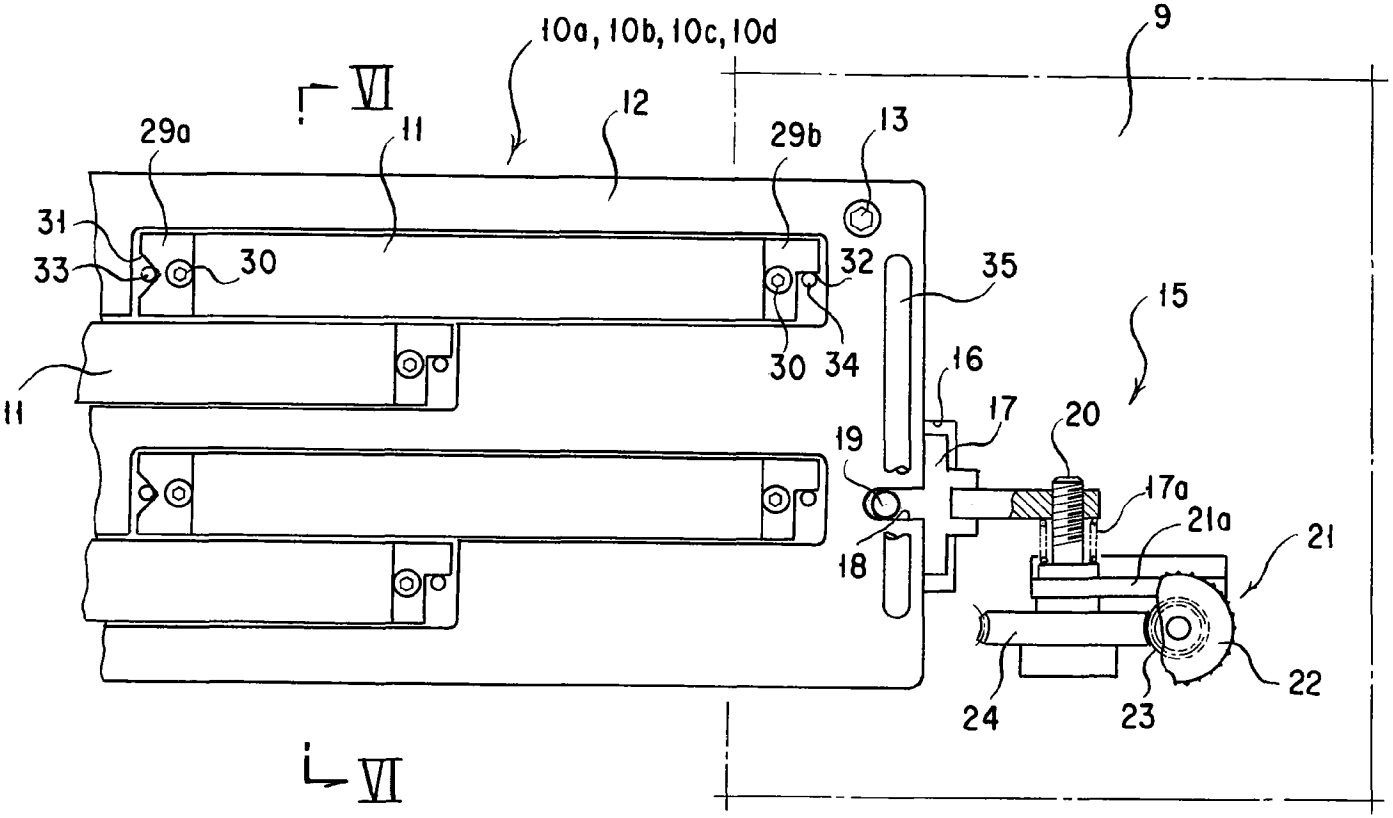
FIG. 5 is a partial plan view illustrating a head supporting plate having short heads mounted thereon and a swing unit shown in part broken in the apparatus.
Figure 6:
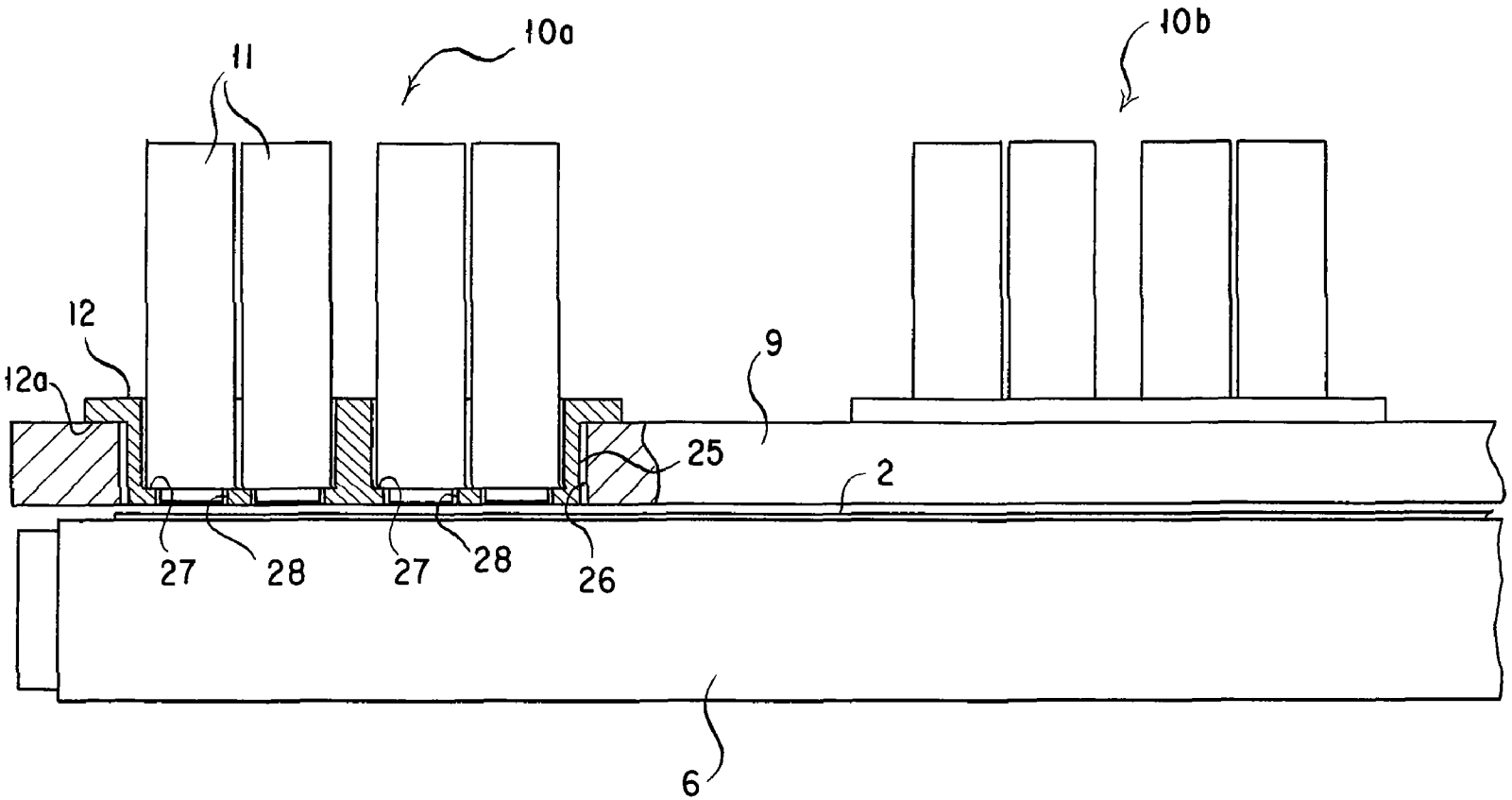
FIG. 6 is a partial cross-sectional view taken along the line VI-VI in FIG. 5.
Figure 7:
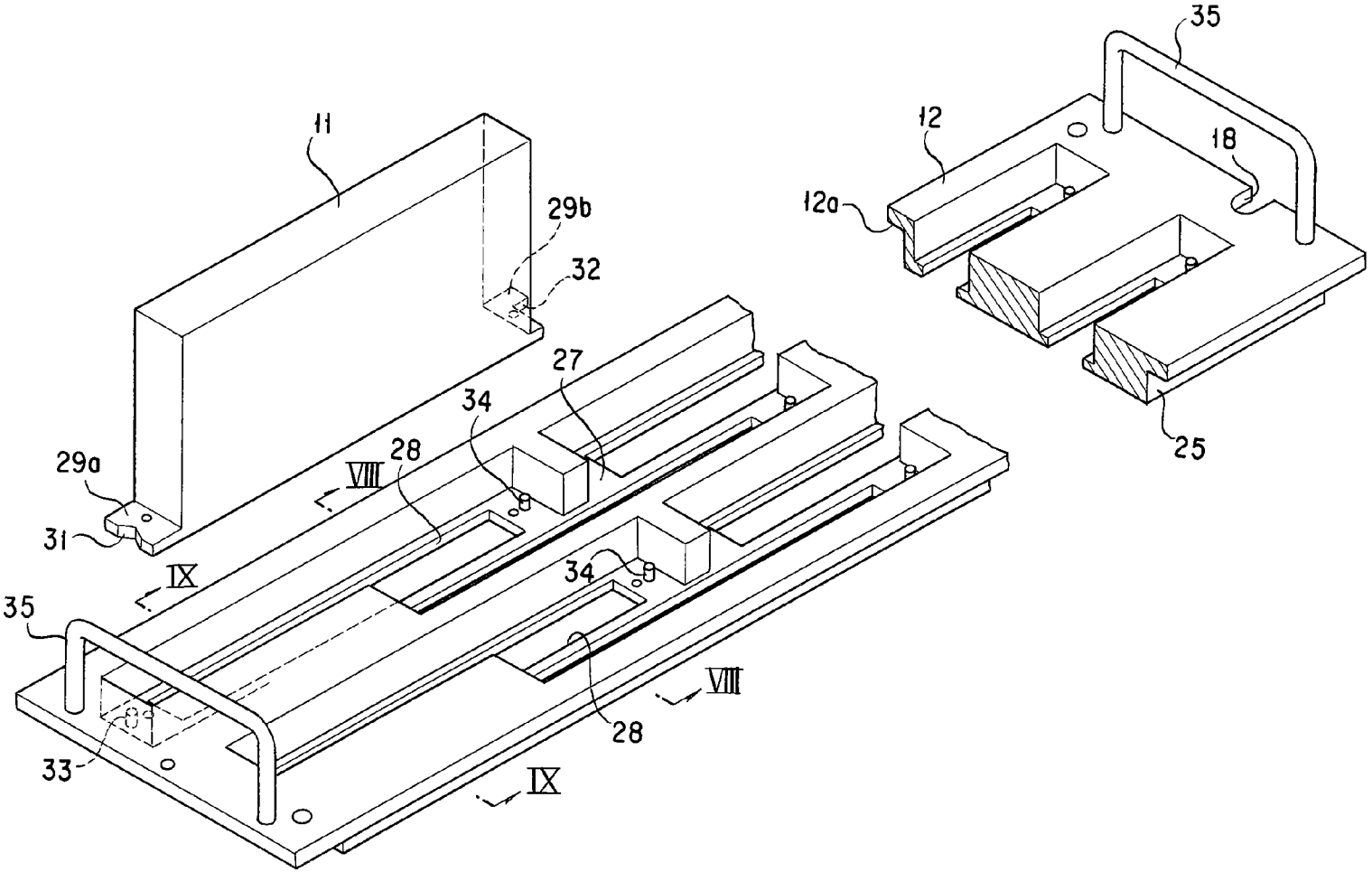
FIG. 7 is a perspective view illustrating the head supporting plate shown in part broken.
Figure 8:
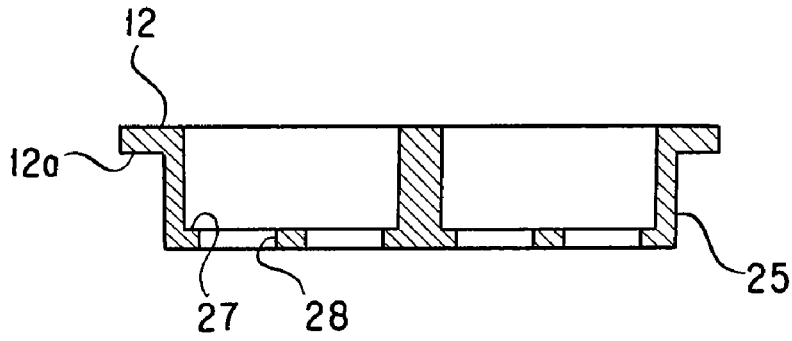
FIG. 8 is a cross sectional view taken along the line VIII-VIII in FIG. 7.
Figure 9:
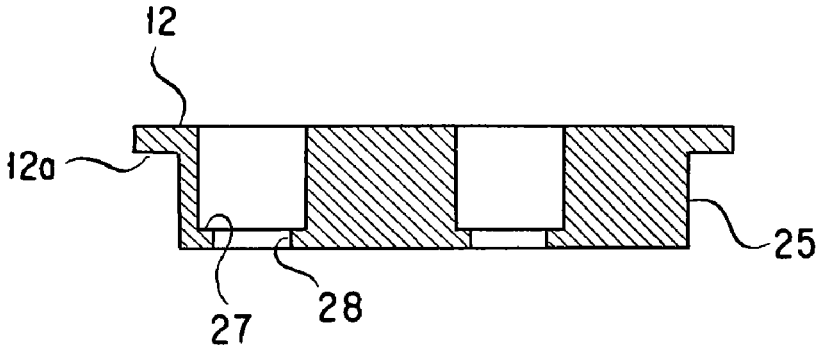
FIG. 9 is a cross sectional view taken along the line IX-IX in FIG. 7.

The swing unit 15 is made up as shown in FIG. 5, and comprises a slide bracket 17 disposed underneath the end of the head supporting plate 12 and received in a recess 16 provided in the carriage 9, so as to be movable in a direction in which the head supporting plate 12 is to swing, a pin 19 protruding on the slide bracket 17 for engaging with a U-shaped groove 18 formed in the head supporting plate 12, a screw 20 in mesh with the slide bracket 17 and a worm wheel assembly 21 for rotating the screw 20. By rotating a wheel 22 in the worm wheel assembly 21 to rotate the screw 20 via a worm 23 provided on the wheel 22 coaxially therewith and a worm wheel 24, the slide bracket 12 is moved, swinging the head supporting plate 12.

The worm wheel assembly, 21 is provided at its screw portion with a spring 17*a* which is wound between a bracket 21*a* of the worm wheel assembly 21 and the slide bracket 17 to absorb a backlash of the screw 20.

The head supporting plate 12 on which the short heads 11 are mounted is designed to be attached to an upper surface of the carriage 9.

Thus, if a short head 11 is mounted on a surface of the head supporting plate 12, a nozzle of the short head would have to be projected from such mounting surface longer by a length equal to a thickness of the head supporting plate 12 and the carriage 9. In that case, the short head 11 must be altered in specification from the ordinary or standard to one in which the nozzle is so altered in length of projection.

Accordingly, in the present invention, as shown in FIGS. 6-9, the head supporting plate 12 on the one hand is provided on its rear side with a portion of projection 25 that projects from a surface of attachment 12*a* where the head supporting plate 12 is attached to the carriage 9 and the carriage 9 on the other hand is provided with a hole 26 in which the portion of projection 25 is fitted whereby fitting the portion of projection 25 in the hole 26 allows the head supporting plate 12 to be attached to the carriage 9. The portion of projection 25 may have a height of projection which in an example is a height corresponding to the thickness of the carriage 9.

The head supporting plate 12 is provided on its obverse side and at a position corresponding to that of the portion of projection 25 with a portion of recess whose inner bottom surface becomes a head mounting surface 27 on which each short head 11 is mounted. And, the head mounting surface 27 is provided at a position corresponding to that of the nozzle of each such short head with a nozzle accepting hole 28 in which the nozzle of each such short head is fitted to project. The head mounting surface 27 may have a depth such that a surface of the nozzle of the short head 11 mounted on the head mounting surface 27 lies at a position which is predetermined to (e.g., the same as) that of the lower surface of the portion of projection 15 of the head supporting plate 12.

Each short head 11 can be mounted on the head mounting surface 27 as shown in FIG. 5 in a manner such that mounting flanges 29*a* and 29*b* provided at one and the other longitudinal ends of the short head 11 are fastened to the head mounting surface 27 by fixing screws 30, 30.

In FIG. 5, it is shown that one flange 29*a* of the short head 11 is formed in its end face with a V-shaped groove 31 and its other flange 29*b* is cut out in the shape of L having a positioning face 32 extending parallel to the longitudinal direction of the short head 11. The V-shaped groove 31 of the one flange 29*a* is engaged with a positioning pin 33 projecting on the head mounting surface 27 and the positioning face 32 of the other flange 29*b* is brought into contact with another positioning pin 34 on the head mounting surface 27 in order to perform positioning the short head 11 on the head mounting surface 27 of the head supporting plate 12. And then, each short head 11 so positioned is fastened with the fixing screws 30 and 30.

The head supporting plate 12 is provided at each of both its longitudinal ends with a carrying handle 35 for convenience of handling the head supporting plate 12.

In the makeup above, the short head 11 is positioned and set on the head mounting surface 27 of the head supporting plate 12 upon engaging the V-shaped groove 31 of the one flange 29*a* with the positioning pin 33 and bringing the positioning surface 32 of the other flange 29*b* into contact with the other positioning pin 34. And, in this state, fastening both flanges 29*a* and 29*b* with the fixing screws 30 and 30 allows each short head 11 as it is positioned to be mounted on the head supporting plate 12.

Since as of this point of time the head mounting surface 27, which is provided as the inner bottom surface of the portion of recess formed in the head supporting plate 12, enters into the hole 26 formed in the carriage 9, its depthwise position can be set as desired. Thus, the spacing between the nozzle face of the short head 11 mounted on the head mounting surface 27 and the fabric 2 as the recording medium can be set independently of the thickness of the carriage 9.

The head supporting plate 12 having each short head 11 mounted thereon in this way can be moved with the carrying handles 35 so as to be attached to the carriage 9. As for the head supporting plate 12 at this time, its one end portion is fitted with the positioning pin 14 protruding on the carriage 9 and the U-shaped groove 18 at its other end portion is fitted with the pin 19 on the slide block 17. And, operating the worm wheel assembly 21 to move the slide block 17 swings the head supporting plate 12 on the pin 14 as its fulcrum in order to adjust the parallelism of the head supporting plate 12 to the direction in which the fabric 2 is traveling. Thereafter, the head supporting plate 12 is fastened to the carriage 9 with the fixing screw 13.

The operation of the worm wheel assembly 21 in which the backlash of the screw 20 is absorbed by the spring 17*a* ensures that the parallelism is adjusted with precision.

While the form of implementation of the invention illustrated above is shown applied to an ink jet recording apparatus of serial printing type in which the line heads 10*a*-10*d* are disposed parallel to the direction of travel of the recoding medium and moved orthogonally to the direction of travel of the recording medium, it is needless to state that the invention may also be applied to one in which the line heads 10*a*-10*d* are disposed orthogonally to the direction of travel of the recording medium and act to print while the recording medium is driven to travel.

What is claimed is:

1. An ink jet recording apparatus, comprising a carriage and a head supporting plate having a line head mounted thereon which comprises a plurality of short heads staggered said head supporting plate being attached to the carriage whereby recording is performed by ink jet printing with the line head on a recording medium positioned beneath the carriage, characterized in that it further comprises:

a portion of projection formed on a rear side of the head supporting plate where the head supporting plate is attached to the carriage, the portion of projection entering into a hole formed in the carriage; and a portion of recess which is formed on an obverse side of the head supporting plate and at a position corresponding to that of the portion of projection and whose inner bottom surface becomes a head mounting surface on which a said short head having a nozzle is to be mounted, said head mounting surface being formed with a nozzle accepting hole adapted to accept the nozzle of said short head for mounting said short head on said head mounting surface.

2. An ink jet recording apparatus as set forth in claim 1, characterized that:

said short head is provided at its two longitudinal ends with two mounting flanges one of which is formed on its end face with a V-shaped groove and the other of which is formed with a positioning surface that is parallel to its longitudinal direction;

the head mounting surface of said head supporting plate is provided with a first positioning pin adapted to engage with the V-shaped groove of the one flange of said short head and a second positioning pin adapted for contact with the positioning surface of the other flange of said short head.

3. An ink jet recording apparatus as set forth in claim 1 or claim 2, characterized in that said head supporting plate has its one longitudinal end portion adapted to fit with a positioning pin provided on said carriage so that the head supporting plate is adapted to swing on a surface of said carriage; and said head supporting plate has its other longitudinal end portion connected to a swing unit mounted on said carriage for swinging the head supporting plate on the surface of said carriage.

* * * * *